United States Patent [19]

Kapustin

[11] Patent Number: 4,740,097

[45] Date of Patent: Apr. 26, 1988

[54] COMBINED LIP LINER AND LIPSTICK MASS

[75] Inventor: Serge Kapustin, Ramsey, N.J.

[73] Assignee: Elleance, Limited, New City, N.Y.

[21] Appl. No.: 935,929

[22] Filed: Nov. 28, 1986

[51] Int. Cl.[4] ..... B41J 3/28

[52] U.S. Cl. ..... 401/35; 132/88.7

[58] Field of Search ..... 401/35; 132/79 C

[56] References Cited

U.S. PATENT DOCUMENTS

| | | | |
|---|---|---|---|
| 192,673 | 4/1962 | Silson . | |
| 201,420 | 6/1965 | Bernard . | |
| 278,750 | 5/1985 | Pisani et al. | D28/4 |
| 1,576,567 | 3/1926 | Buhl-Bonanno | 132/79 C |
| 1,810,249 | 6/1931 | Koehler | 132/79 C |
| 1,933,538 | 11/1933 | Brazelton | 132/1 |
| 2,162,584 | 6/1939 | Kole | 132/79 C |
| 2,196,127 | 4/1940 | Stogran | 132/79 C |
| 2,264,482 | 12/1941 | Ridner et al. | 132/79 |
| 2,523,683 | 9/1950 | De Mario | 206/56 |
| 2,566,722 | 9/1951 | Friedberg | 91/54.7 |
| 2,834,356 | 5/1958 | Weiler | 132/88.7 |
| 2,970,083 | 1/1961 | Bell | 167/90 |
| 3,062,221 | 11/1962 | Quinn | 132/88.7 |
| 3,062,222 | 11/1962 | Quinn | 132/88.7 |
| 3,130,124 | 4/1964 | Ferris et al. | 167/42 |
| 3,192,933 | 7/1965 | Prince | 401/35 |
| 3,279,999 | 10/1966 | Harrison et al. | 167/85 |
| 3,338,397 | 8/1967 | Noyack et al. | 206/56 |
| 3,479,429 | 11/1969 | Morshauser et al. | 424/63 |
| 4,291,018 | 9/1981 | Oeda et al. | 424/64 |

FOREIGN PATENT DOCUMENTS

| | | |
|---|---|---|
| 647759 | 11/1964 | Belgium . |
| 1083153 | 1/1955 | France . |

*Primary Examiner*—Gregory E. McNeill

*Attorney, Agent, or Firm*—Fleit, Jacobson, Cohn & Price

[57] ABSTRACT

A lipstick bullet includes a lip liner lead in intimate contact with a lipstick mass. The lip liner lead extends along a portion of the outer periphery of the lipstick, abutting the lipstick mass along a line of demarcation extending between two points spaced apart on the periphery of the lipstick bullet. The lip liner is formed integrally with the lipstick so that upon transverse movement of the lipstick bullet across the lip, two contiguous zones are produced. One zone includes only lip liner and the other zone includes only lipstick.

18 Claims, 1 Drawing Sheet

COMBINED LIP LINER AND LIPSTICK MASS

BACKGROUND OF THE INVENTION

Lips are one of the most sensual parts of a woman's face. A change in their size, shape and color can noticeably effect her beauty. Use of lip make-up enables a woman to perfect her lips in size, shape and color. In choosing the right color for her lips, a woman may consider the following: color of her hair, color of her skin, color of her eyes, the style and color of her dress and accessories, the purpose of the occasion, and her mood. That is why lip make-up plays such an essential roll in a woman's overall appearance.

The majority of cosmetic products that fall within the lip make-up category are lipsticks, lip liners, lip pencils, lip glosses and lip foundations. The consistency of these lip make-up products vary from solid, to semi-solid to liquid, which, for lipsticks and lip liners, the solid is the most common form.

The majority of lipsticks on the market are available in a cylinder tapered like shape with ½ inch diameter at the bottom. The upper part of the lipstick bullet is available in a number of different shapes, including fishtail, chisel cut, teardrop and contoured.

The bottom portion of the lipstick bullet fits into a "cup". This cup is raised and lowered in the lipstick container, thereby raising and lowering the bullet to the perfect height for application. Besides the shape and the color differences, all lip products may differentiate from each other in texture, in shimmer on the lips, in taste and aroma, in color-lasting property, in the treatment properties, in feeling on the lips, in moisturizing properties, in featherproofing properties, etc.

Feathering—"Bleeding" of lip cosmetics refers to the extension of color beyond an edge or border, especially so as to combine with a contiguous color or to affect an adjacent area. Bleeding usually occurs by lip color running in the lip's wrinkled area and onto the skin surrounding the lips.

The main function of a lip liner is to provide a fine line around the lips. Contouring (outlining) the lips gives a woman the freedom to change the shape and size of her lips, enhance them, and improve the overall aesthetic impact of her make-up.

In recent years, a new trend toward the use of lip liners has increased in popularity. There are new properties for lip liners which they may possess in addition to their traditional function of providing a line around the lips. Some of these new properties are moisturization treatment and featherproofing.

The diameter of the lip liner's lead is normally much smaller (thinner) than the diameter of the lipstick's bullet. It may vary from 1/16 to ⅛ inch.

The density (strength) of a lip liner's lead is normally higher (stronger) than the density of a lipstick bullet, to allow the lip liner's lead to withstand the pressure of application.

A lip liner becomes a lip pencil when the lead is surrounded with wood (inserted in wood, as in a pencil) that supports the lead. The lead of a lip pencil, therefore, may be softer than that of a lip liner due to the support of the pencil for the lead.

All lip product formulations available in the solid form, including lipsticks, lip liners, lip pomades, lip glosses, etc., can be described with reference to the following groups of ingredients: Wax group, Fats/Semi Solids group, Viscous Oils group, Thin Oils group, Colorants group, Anti Oxidants, Preservatives and Fragrances(s). In addition a vast majority of contemporary lip products may contain some active ingredients, such as: vitamins, sunscreens, proteins and other special treatment ingredients.

SUMMARY OF THE INVENTION

The present invention includes a lipstick bullet having a lip liner lead in intimate contact with a lipstick mass. The lip liner lead extends along a portion of the outer periphery of the lipstick mass, abutting the lipstick mass along a line of demarcation extending between two points spaced apart on the periphery of the lipstick bullet. The lip liner is formed integrally with the lipstick mass so that upon transverse movement of the lipstick bullet across an upper lip, two contiguous zones are produced. One zone includes only lip liner and the other zone includes only lipstick.

A goal of the present invention is to provide a lipstick bullet, with lip liner capabilities. A woman will thereby be able to apply lipstick and lip liner, both at the same time.

The lip liner is positioned on the lipstick mass so that during use, the lip liner maintains corner positioning, and outlines the outer lip with lip liner and at the same time the lipstick formula portion covers the inner lip portions. A woman is thereby able to outline her lips while lipstick is being applied to the inner portion of her lip.

This product may also be used like a lip pencil, utilizing the pointed tip of the lip liner after a complete application. Both the lipstick and lip liner are independently and dependently functional within the one product.

Dependently, both lip liner and lipstick mass are simultaneously applied to the upper and bottom lip by a single stroke. Independently, the bullet can be turned, enabling the lip liner to be used as a fine point while outlining the contour of the lip with the lip liner portion.

It is an object of the present invention to provide a lipstick bullet with lip liner capabilities.

It is another object of the present invention to provide a lipstick bullet which includes a lip liner lead portion and a lipstick mass portion for producing two separate zones of lip liner and lipstick.

It is still yet another object of the present invention to provide a lipstick bullet with a lip liner lead portion and a lipstick mass portion for application of a featherproofing lip liner to outline an upper lip while at the same time applying a lipstick formula to fill an inner lip portion.

It is still yet another object of the present invention to provide a lipstick bullet having a lipstick mass portion and a lip liner lead portion which are contiguous along a line of demarcation so that upon transverse movement of the bullet, two separate zones are created, one including only lip liner and the other only including lipstick.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
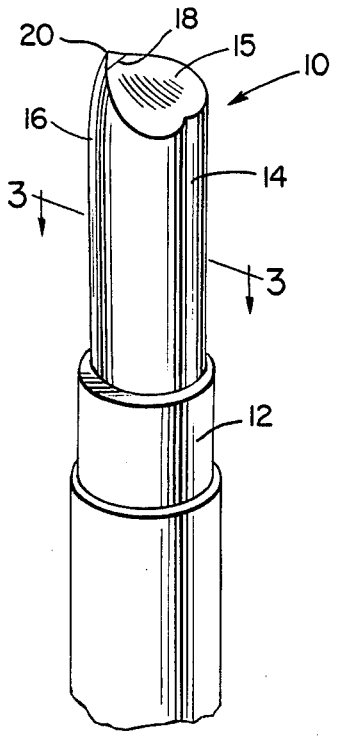
FIG. 1 is a perspective view of a lipstick bullet slidably mounted in a lipstick case.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
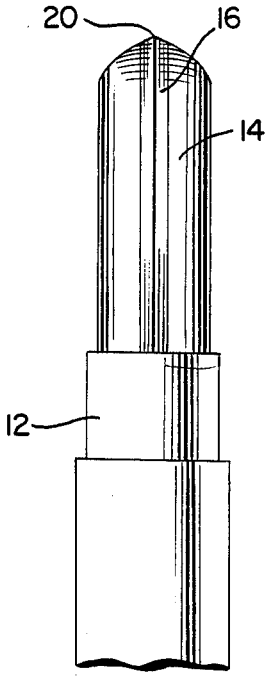
FIG. 2 is a front view of the lipstick bullet and case shown in FIG. 1.
Figure 3:
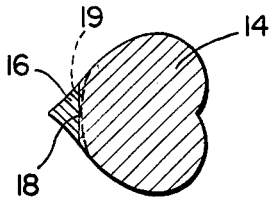
FIG. 3 is a sectional view taken along the line 3—3 of FIG. 1.

With reference to the drawings, in general, and to FIGS. 1 through 3, in particular, a lipstick bullet embodying the teachings of the subject invention is generally designated as 10. The lipstick bullet 10 is slidably mounted in a casing 12 having a cover (not shown). By actuation of a mechanical mechanism, the height of the lipstick bullet 10 is raised or lowered.

The casing accommodates a lipstick bullet. The shape of the lipstick bullet shown is not meant to be limiting, but is an example of a shape which would fit within a casing having a base portion cup of approximately one-half inch in diameter.

The lipstick bullet 10 includes a lipstick mass portion 14 and a lip liner lead portion 16 which are in intimate contact with each other along a straight line 18. Line 18 is a separation between the intimately contacting lip liner portion and lipstick mass portion and is continuous through the entire height of the bullet 10. Therefore, as the lipstick bullet is worn down by usage, there will still be a separation line between the lip liner and the lipstick.

The lipstick bullet 10 is in the shape of a heart, however, it is contemplated as being within the scope of the present invention that the bullet is teardrop-shaped, oval, round or any other shape so long as there is a line of demarcation between the lip liner lead and the lipstick portion of the lipstick bullet which extends between two points spaced apart on the periphery of the lipstick bullet so that upon transverse movement of the bullet there is little mixing of the lip liner and lipstick mass as will be encountered during actual application of the lip liner and lipstick mass.

In an alternate embodiment, separation line 19, between the lip liner and lipstick mass, shown in dotted line in FIG. 3, is curved so as to create a third zone or transition zone of application. The transition zone would include, during application, a mixture of the lip liner and lipstick mass so as to separate, aesthetically, the zone of only lipstick from the zone of only lip liner. The line 19 may be curved in the opposite direction, undulating or zig-zag to create a transition zone during lip application. However, it is to be noted that the lip liner and the lipstick mass occupy opposite portions of the bullet so that there is no total mixing of the liner and lipstick.

The lip liner portion 16 is in the shape of an equilateral triangle, having sides approximately equal to 1/16 inch. The lip liner portion projects from the periphery of the exterior surface of the lipstick portion 18 so that upon movement of the lipstick bullet across the lips, with the lip liner applied to the outermost edge of the lip, two zones of lip cosmetics are applied. The two zones include a line of demarcation between the lip liner and lipstick. The separation line 18 between the lip liner and the lipstick portion is a straight line to avoid to the most extent possible, mixing of the liner and the lipstick when the lipstick bullet 10 is moved across the upper or bottom lip during application.

In FIG. 2, the lip liner lead 16 is shown projecting above the uppermost concave area 15 of the lipstick portion 14. The lip liner projecting above the lipstick enables the pointed tip 20 to be used as a lip liner for application of lip liner to the upper lip or lower lip 24.

In an alternate method of bottom lip application, the holder 12 is rotated 180° so that the lip liner lead portion of the lipstick bullet is closest to the outermost edge of the lips. The remainder of the lip portion is coated with lipstick in the application position normally used for lipstick application.

Figure 8:
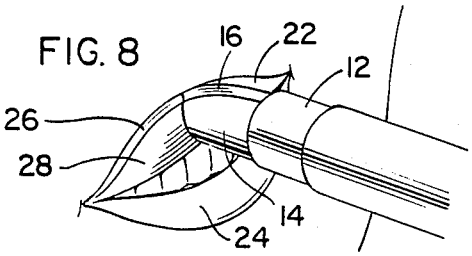
FIG. 8 illustrates the simultaneous application of lip liner and lipstick by the lipstick bullet shown in FIG. 1.

During normal application to the upper lip, the lipstick bullet 10 would be applied as shown in FIG. 8, with the lipstick bullet 10 held in the position shown. As shown in FIG. 8, the lipstick bullet applies in a single stroke, a zone 26 of lip liner and a zone 28 of lipstick.

The lip liner lead 16 may have a higher hardness than the lipstick portion 14. The lead 16 may possess different properties, including featherproof properties which restrains the migration of the lipstick from zone 28 beyond the upper lip and is equally effective in preventing migration of lipstick from the lower lip 24 beyond the lip liner.

The lip liner occupies a surface area equal to 3 to 25% of the total cross-sectional surface area of the bullet as shown in FIG. 3. Preferably, the lip liner occupies 5 to 15% of the total cross-sectional surface area of the bullet.

The inclination of the uppermost surface of the bullet 10 is such that a distance between the uppermost portion of lip liner 16 (tip 20) to the lowermost portion of the lipstick mass 14 at the uppermost surface of the bullet is equal to 1/32 inch to 5/16 inch. The lip liner would always be at a level at least equal to the highest portion of the lipstick mass of the uppermost bullet surface, and preferably project above the lipstick mass more than 1/32 inch, preferably 3/32 inch.

It is contemplated that the lip liner may be of the same color or of different color from the lipstick mass portion. However, the lip liner will preferably act as an outer limit against the migration of the lipstick.

In producing the lipstick bullet 10, a two part mold 30, 32 is used, having a common base 34. Base 34 includes projections 36 and 48. Projection 36 extends from a flat base line portion 38 in a curved manner along segment 39 until reaching stop portion 40 which extends perpendicular to base portion 38.

Figure 7:
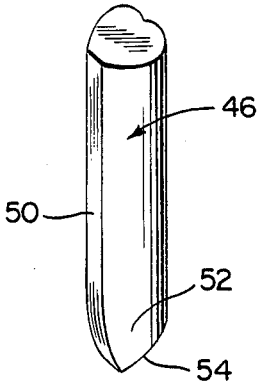
FIG. 7 is a perspective view of the mold insert shown in FIG. 4.

Cavity 42 includes an area sufficient to hold the completed bullet 10. Cavity 42 extends from curved segment 39 to pouring overflow reservoir portion 44. An insert 46 of a truncated heart-shaped configuration, as shown in FIG. 7, is first placed in cavity 42. Projections 48 align mold portions 30 and 32 with the base 34.

Figure 4:
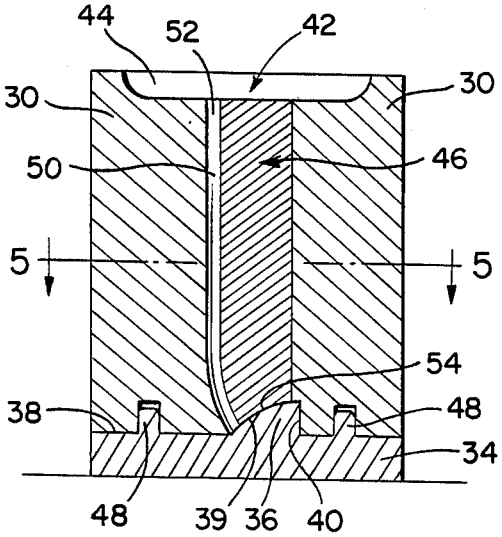
FIG. 4 is a sectional view of a mold assembly for producing the lipstick bullet of FIG. 1.

Insert 46 is in the shape of the intended final form of the lipstick mass portion of the lipstick bullet. The insert 46 maybe of metal or a premolded lipstick bullet. As seen in FIG. 7, insert 46 includes a flat edged portion 50 which extends parallel to a longitudinal axis of the insert 46. At a bottom end 52 of the insert 46, the flat edge 50 curves inwardly, terminating at concave end 54, as best shown in FIG. 4. Concave end 54 is complimentarily shaped to curved segment 39 of the base mold 34.

Figure 6:
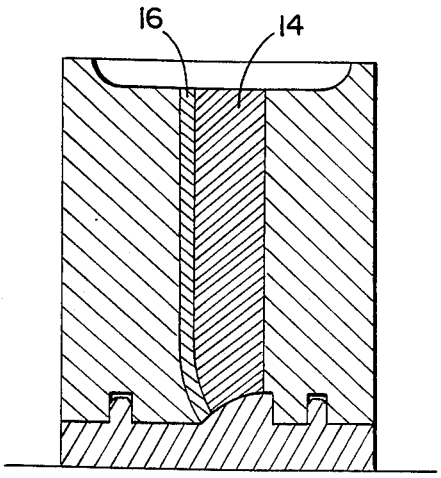
FIG. 6 is a sectional view of the lipstick bullet shown in FIG. 1, cast in a mold assembly.
Figure 5:
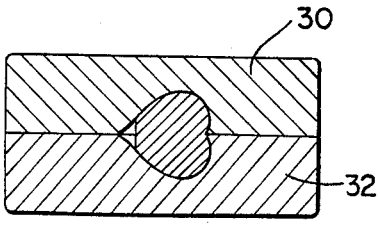
FIG. 5 is a sectional view taken along the line 5—5 of FIG. 4.

When the insert 46 is positioned in the cavity 42, a lip liner mass in a liquified state is poured into the cavity portion 52 formed between the flat edge 50 of insert 46 and the wall of the cavity 42. The mold is chilled until the lip liner mass 16 is solidified. The base of the mold and then one of the mold halves 30 or 32 is removed from the base 34 and the insert 46 is removed. Lip liner lead 16 remains in the mold in a solid state as shown in FIG. 6.

The mold is then reassembled and a lipstick mass in a liquified state is poured into the cavity 42 in the area previously occupied by the insert 46. The mold is then chilled until the lipstick mass 14 is solidified as shown in FIG. 6. The mold is then opened and bullet 10 including the lip liner 16 and lipstick 14 masses, attached to each other in intimate contact, is removed.

Also, the process of forming the lipstick bullet may be reversed such that an insert is used to occupy the space of the lip liner lead while the lipstick mass portion is formed. Then the lip liner lead insert is removed to form the lip liner lead in intimate contact with the lipstick mass.

In another method of producing a lipstick bullet, lip liner lead 16 is molded or extruded into a lead form. The lip liner lead is placed in the cavity 42 of the mold. The insert 46 is not necessary by this method.

A lipstick mass in a liquified state is then poured in the cavity 42 having a lip liner mass therein. The mold is then chilled until the lipstick mass 14 is solidified. When the mold is opened, a lipstick bullet 10 including a lip liner 16 and lipstick mass 14, attached to each other in intimate contact, is removed.

It is contemplated as being within the scope of this invention that the mold and insert shape may be made to accommodate a particular desired shape for the lipstick bullet. The lip liner and lipstick mass would still be in intimate contact along a line extending between two points spaced about the periphery of the lipstick bullet.

Having described the invention, many modifications thereto will become apparent to those skilled in the art to which it pertains without deviation from the spirit of the invention as defined by the scope of the pending claims.

I claim:

1. A lip cosmetic comprising:

a lipstick bullet including a lip liner portion and a lipstick portion in intimate contact with each other along substantially the entire length of said lipstick bullet, said lip liner portion projecting laterally from one side of said lipstick portion.

2. A lipstick cosmetic according to claim 1, wherein said lip liner portion is in contact with said lipstick portion along a line extending between two points located on the periphery of said lipstick bullet so that when said lipstick bullet is spread across the lip, a zone of lip liner is formed in contact with a zone of lipstick on the lip.

3. A lip cosmetic according to claim 2, wherein said lip liner portion is harder than said lipstick portion.

4. A lip cosmetic according to claim 3, wherein said lipstick bullet is in a shape having a tip forming said lip liner portion.

5. A lip cosmetic according to claim 3, wherein said lip liner portion and said lipstick portion each extend to said periphery of said lipstick bullet.

6. A lip cosmetic according to claim 2, wherein said lip liner portion is of the same hardness as said lipstick portion.

7. A lip cosmetic according to claim 2, wherein said lip liner portion is softer than said lipstick portion.

8. A lip cosmetic according to claim 2, wherein said lip liner portion is the same color as said lipstick portion.

9. A lip cosmetic according to claim 2, wherein said lip liner portion is a different color from said lipstick portion.

10. A lipstick comprising:

a lipstick bullet including a lip liner portion and a lipstick portion in intimate contact with each other, said lip liner portion projecting laterally from one side of said lipstick portion and projecting above said lipstick portion.

11. A lipstick according to claim 10, wherein said lip liner portion is in contact with said lipstick portion along a line extending between two points located on the periphery of said lipstick bullet so that when said lipstick bullet is spread across the lip, a zone of lip liner is in contact with a zone of lipstick on the lip.

12. A lipstick according to claim 11, wherein said lip liner portion is harder than said lipstick portion.

13. A lipstick according to claim 12, wherein an uppermost surface of said lipstick portion is concave.

14. A lipstick according to claim 12, wherein said lip liner portion and said lipstick portion each form part of said periphery of said lipstick bullet.

15. A lipstick comprising:

a lipstick bullet including a first portion and a second portion in intimate contact with each other, said first portion projecting laterally from one side of said second portion and projecting above a concave terminal end of said second portion.

16. A lipstick according to claim 15, wherein said first portion is in contact with said second portion along a line extending between two points located on the periphery of said lipstick bullet so that when said lipstick bullet is spread across the lip, a zone made of said first portion is in contact with a zone made of said second portion on the lip.

17. A lipstick according to claim 16, wherein said first portion is harder than said second portion.

18. A lipstick according to claim 17, wherein said first portion is lip liner and said second portion is lipstick.

* * * * *